US011268338B2

(12) United States Patent
Tallini

(10) Patent No.: US 11,268,338 B2
(45) **Date of Patent: *Mar. 8, 2022**

(54) RADIAL CONDUIT CUTTING SYSTEM

(71) Applicant: OTTO TORPEDO COMPANY, Pleasantville, PA (US)

(72) Inventor: Richard F. Tallini, Toledo, OH (US)

(73) Assignee: Otto Torpedo Company, Pleasantville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/760,415

(22) PCT Filed: Oct. 31, 2018

(86) PCT No.: PCT/US2018/058416

§ 371 (c)(1),
(2) Date: Apr. 29, 2020

(87) PCT Pub. No.: WO2019/089733

PCT Pub. Date: May 9, 2019

(65) Prior Publication Data

US 2020/0340320 A1 Oct. 29, 2020

Related U.S. Application Data

(60) Provisional application No. 62/579,572, filed on Oct. 31, 2017.

(51) Int. Cl.

| | |
|---|---|
| ***E21B 29/02*** | (2006.01) |
| ***F42D 3/04*** | (2006.01) |
| ***F42D 1/04*** | (2006.01) |

(52) U.S. Cl.
CPC ..... *E21B 29/02* (2013.01); *F42D 1/04* (2013.01); *F42D 3/04* (2013.01)

(58) Field of Classification Search
CPC . E21B 29/00; E21B 29/02; F42D 1/04; F42D 3/04
See application file for complete search history.

(56) References Cited

U.S. PATENT DOCUMENTS 4,592,899 A * 6/1986 Caggiano ..... F01N 3/0211 422/180
6,598,679 B2 * 7/2003 Robertson ..... E21B 29/02 166/297

(Continued)

*Primary Examiner* — Christopher J Sebesta
(74) *Attorney, Agent, or Firm* — Jonathan M. D'Silva; MMI Intellectual Property

(57) ABSTRACT

An apparatus housing for a cutting system for radially projecting a flow of heated gas to cut from an internal surface through an external surface of a conduit. The cutting system adapted to be positioned within the conduit comprising an igniter, an extension housing, and an apparatus housing. The apparatus housing has a movable sleeve section and a nozzle assembly. The nozzle assembly comprises a conical head with through holes for evenly dispersing the flow of heated gas. A retainer abuts a diverter. The diverter imposes a 90-degree bend in the direction of the flow of the heated gas to cause the flow of heated gas to move the sleeve section away from the apparatus housing to expose a circumferential diverter gap through which the flow of heated gas projects radially to perform the cutting function. A spindle provides structure for the nozzle assembly and maintains the position of the nozzle assembly in the apparatus housing.

23 Claims, 15 Drawing Sheets

(56) References Cited

U.S. PATENT DOCUMENTS

| | | | | |
|---|---|---|---|---|
| 2007/0186988 | A1* | 8/2007 | Liu | B01F 5/061<br>138/113 |
| 2007/0241512 | A1* | 10/2007 | Tsuboi | F16J 15/344<br>277/370 |
| 2013/0292181 | A1* | 11/2013 | Blange | E21B 7/18<br>175/61 |
| 2014/0034315 | A1* | 2/2014 | Tallini | F42D 1/045<br>166/297 |
| 2018/0015433 | A1* | 1/2018 | Hatch | B01F 15/0261 |

* cited by examiner

RADIAL CONDUIT CUTTING SYSTEM

BACKGROUND

In oil and gas well operations conduit strings will sometimes get stuck in the borehole and cannot be removed. When this problem arises, it is sometimes necessary for the rig operator to cut the conduit string as close to where the conduit is stuck to retract the "free" conduit and to allow the remaining stuck conduit to be fished. A variety of conduit cutters are known to perform this task. One in particular, gas forming thermite pipe cutters, ignite combustible pyrotechnic materials to create a radially directed flow of heated gas used to cut the conduit into two portions. Many previous configurations of cutting systems are known, but what is presented herein are improved configurations based on surprising results derived from unexpected configurations of various features.

SUMMARY

What is presented is an apparatus housing for a cutting system for radially projecting a flow of heated gas to cut from an internal surface through an external surface of a conduit. These conduits may be for oil, gas, mining, and underwater pressure sealed tool applications. The cutting system is adapted to be positioned within the conduit and comprises an igniter, an extension housing, and an apparatus housing. Combustible pellets are not loaded into the apparatus housing. The apparatus housing comprises a movable sleeve and a nozzle assembly within the apparatus housing. The nozzle assembly comprises a conical head, a spindle abutting the conical head, a retainer abutting the spindle, and a diverter. The conical head comprises a conical diverter and a jacket. The jacket comprises a plurality of jacket through holes for dispersing the flow of heated gas evenly through the nozzle assembly and for increasing the pressure and velocity of the flow of heated gas. The spindle comprises a stalk and a sheath. The stalk provides structure for the nozzle assembly and maintains the position of the nozzle assembly in the apparatus housing. The sheath comprises a plurality of sheath through holes that align with the jacket through holes. The sheath through holes also increases the pressure and velocity of the flow of heated gas through the nozzle assembly. The diverter increases the pressure and velocity of the flow of heated gas after the flow of heated gas passes through the retainer. The diverter imposes a 90-degree bend in the direction of the flow of the heated gas, without the use of gentle curves or radius, to cause the flow of heated gas to move the movable sleeve away from the apparatus housing to expose a circumferential diverter gap through which the flow of heated gas projects radially to perform the cutting function of the cutting system. Epoxy or high temperature sealant may be used to seal any loose space within the apparatus housing.

In some embodiments, the retainer comprises a heat resistant material to protect the sheath and the inner wall of the nozzle assembly from the heat generated by the flow of heated gas. In some embodiments, the retainer includes a lip to protect the nozzle assembly at the circumferential diverter gap. The retainer also comprises a plurality of retainer through holes that align with the sheath through holes. In some embodiments, the retainer is mounted within the apparatus housing with screw threads.

In some embodiments, the stalk and the sheath are two separate components. In some embodiments, the conical diverter and the jacket are two separate components. In some embodiments, the jacket surrounds at least a portion of the spindle. In some embodiments, the jacket and the sheath are a single component.

In some embodiments, the spindle is installed within the apparatus housing with screw threads. In some embodiments, the apparatus housing comprises an internal lip against which the various components of the nozzle assembly are pushed. In various embodiments, heat resistant tubing may be incorporated into the sheath through holes.

In some embodiments, the conical head has a length to diameter ratio greater than 1.0. In other embodiments, the conical head has a length to diameter ratio between than 0.43 and 1.5. The conical diverter has an angle of less than 41 degrees. In some embodiments, the conical diverter has an angle of 31 degrees. The retainer has a length to width ratio between 0.5 and 0.25.

The apparatus housing may include a constricted section that supports combustible pellets above the nozzle assembly. In some embodiments, the constricted section is a retaining nut. In some embodiments, the constricted section burns away after ignition of the combustible pellets to reduce the level of constriction and present an unobstructed flow path to said conical head. The constricted section builds the pressure in said apparatus housing to aid conduit cutting when pressures in conduit are in the range of zero to 1,000 psi.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
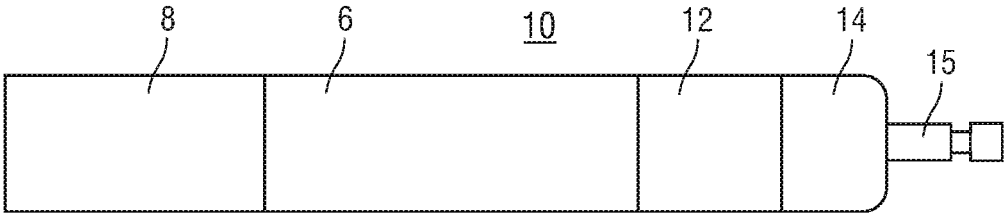
FIG. 1 shows a perspective view of a completely assembled cutting apparatus.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

In many drilling operations for oil, gas, mining, and underwater pressure sealed tool applications, a conduit string is used to drill a well bore into the surface of the earth. The conduit string is typically a length of conduit, such as drill pipe, extending from the earth's surface drilling the well bore as it moves through the earth.

During drilling operations, the conduit string may become stuck in the borehole. If the conduit string cannot be removed, then it must be cut at the location as close to as where the conduit is stuck as possible. Cutting the conduit string using a cutting system discussed below, involves lowering the cutting system inside the conduit string and activating the cutting system. This causes a radially projected flow of heated gas to cut the conduit from the internal surface of the conduit through the external surface of the conduit, completely severing the conduit string into two portions. The portion above the borehole can be removed for reuse in another well bore. It should be understood there may be other situations needing to implement this cutting system, which are different from the salvage operation discussed above.

Prior art cutting systems developed by the inventor are described and claimed in U.S. Pat. Nos. 9,677,364 and 9,677,365. Those systems were an improvement over older devices in that those devices harnessed chamber pressure characteristics to progressively increase the pressure and velocity of the flow of heated gas as it travels through the cutting assembly. While these configurations did in fact create cutting apparatus that were effective, the diverter systems in those embodiments directed the flow of heated gas against the inside of the nozzle assembly which was intended to provide the force that would move the movable sleeve and to expose a circumferential diverter gap that would direct the flow of heated gas against the inside of the conduit and provide the cutting function. The problem with these systems is that the pressure buildup was so effective that the inner surface of the nozzle assembly experiences the full force of the flow of heated gas before the movable sleeve is moved out of the way. This creates wear and damage to the cutting system and reduces the life and reusability of the cutting system. What is presented are improvements that increase the life and durability of cutting systems.

One other limitation of prior art cutting systems is also inherent in the design of the prior art nozzle assemblies. Prior art cutting systems essentially comprise two pieces: an igniter and a nozzle assembly. The igniter comprises essentially a smaller amount of combustible material and a system for causing the initial ignition of the combustible material. The nozzle assembly contained all of the combustible material required to create the heated gas for the cut as well as the nozzle assembly that directed the flow of heated gas against the conduit to be cut. The user initiates the ignition of smaller amount of combustible material in the igniter which creates a flow of heated gas that moves into the nozzle assembly where it starts a chain reaction of igniting the combustible material in the nozzle assembly to create even more heated gas that is driven through the nozzle assembly and out to cut the conduit.

These prior art nozzle assemblies are typically long tubes that houses all of the required combustible material as well as the nozzle assembly components. These tubes are typically cumbersome to construct and any requirements in the nozzle assembly that requires different diameter for insertion of nozzle assembly components would be difficult, if not impossible to perform. The cutting systems shown herein teach nozzle assembly configurations that cannot be done with the prior art assemblies.

FIG. 1 shows the cutting apparatus 10 comprises an igniter 8, an extension housing 6, and an apparatus housing 12 that includes a movable sleeve section 14. The igniter 8 is of any type suited for cutting systems in the art and would be used as previously described. The extension housing 6 is sized to hold the required amount of combustible material needed to generate the flow of heated gas. The length of the extension housing 6 is determined by the specific application and can be varied as needed.

Figure 1A:
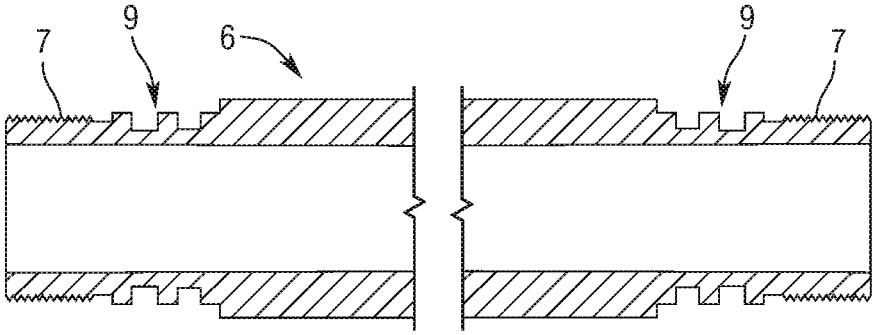
FIG. 1A shows cross sectional view of an extension housing portion of the cutting apparatus of FIG. 1.

FIG. 1A shows that the extension housing 6 has threaded ends 7 on either end and therefore either end may be used to mount the igniter 8 or the apparatus housing 12 interchangeably. The extension housing also has groves 9 for o-rings (not shown) that are used to form seals between the extension housing 6, the igniter 8 and the apparatus housing 12. The combustible material housed within is preferably thermite pellets which produce a flow of heated gas strong enough to cut through conduits of various thicknesses. The number of thermite pellets is preselected depending on the characteristics of the conduit to be cut. The length and/or surface geometry of the thermite pellets could also be manipulated based on the characteristics of the conduit to be cut. The length of the extension housing 6 can also be varied to accommodate a different number of thermite pellets as needed for the particular application. It is also possible to use the longest extension housing 6 that is necessary to make the most difficult cuts, and to simply load less combustible material (fewer pellets) into the longer housing leaving the empty space unoccupied to accomplish the simpler cuts.

Figure 2:
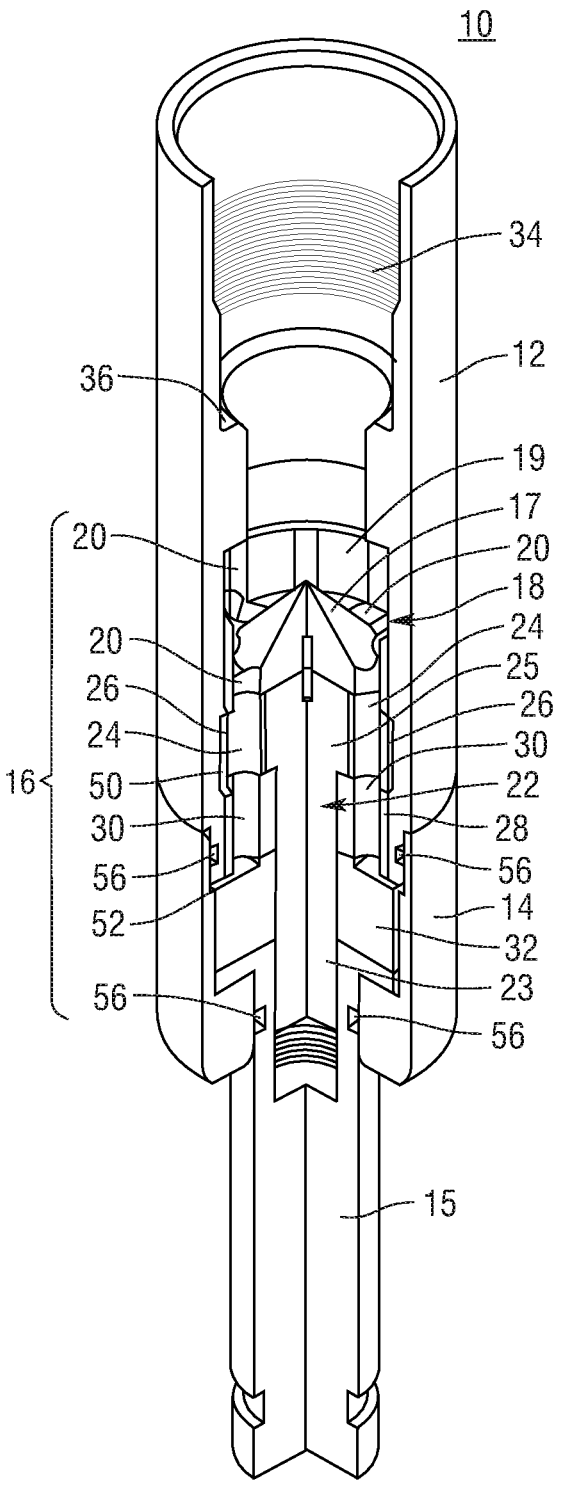
FIG. 2 shows a perspective cut-out view of the apparatus housing of a cutting apparatus for radially projecting a flow of heated gas.
Figure 2A:
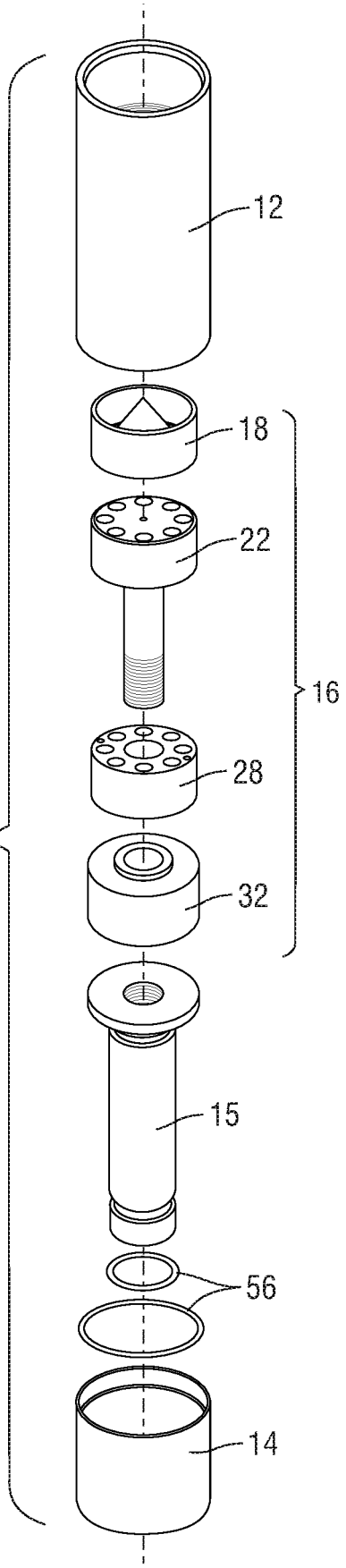
FIG. 2A shows an exploded view of the apparatus housing of FIG. 2
Figure 3:
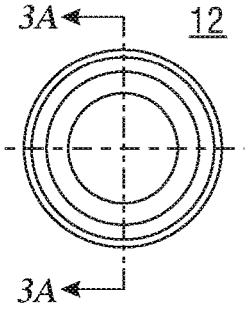
FIG. 3 shows a top view of the apparatus housing of FIG. 2.
Figure 3A:
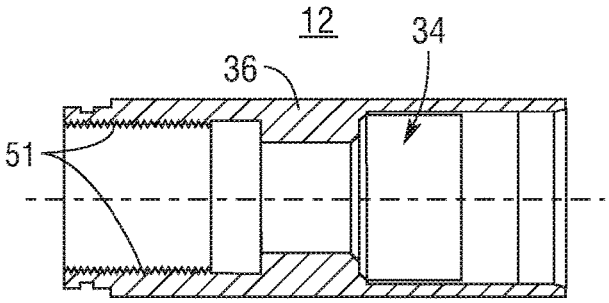
FIG. 3A shows a cross-sectional view of the apparatus housing of FIG. 3.
Figure 4:
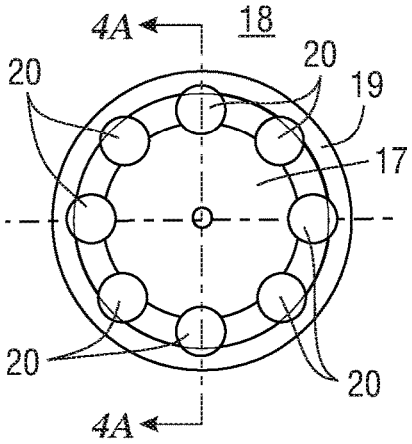
FIG. 4 shows a top view of the conical head of FIG. 2.
Figure 4A:
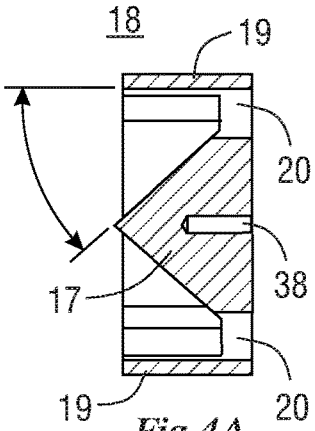
FIG. 4A shows a cross-sectional view of the conical head of FIG. 4.
Figure 4B:
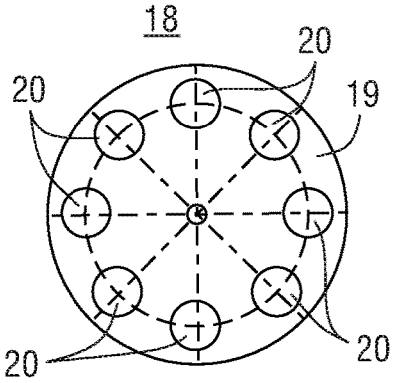
FIG. 4B shows a bottom view of the conical head of FIG. 4.
Figure 5:
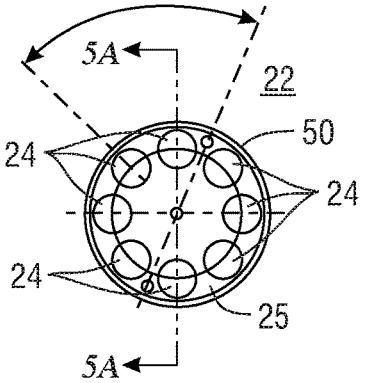
FIG. 5 shows a top view of the spindle of FIG. 2.
Figure 5A:
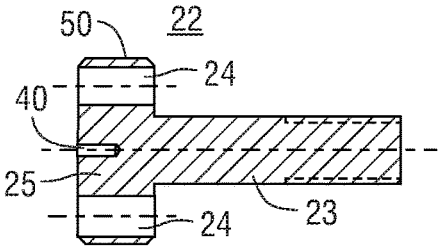
FIG. 5A shows a cross-sectional view of the spindle of FIG. 5.
Figure 5B:
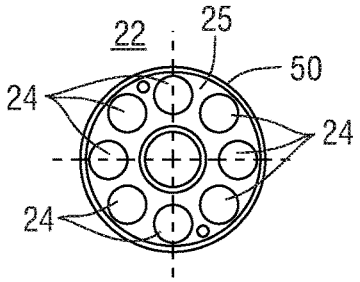
FIG. 5B shows a bottom view of the spindle of FIG. 5.

In the field, the cutting apparatus 10 is assembled as shown in FIG. 1. First the assembled apparatus housing 12 with the movable sleeve 14 is mounted to the extension housing 6. the extension housing 6 is then loaded with sufficient combustible material for the required application. Before the igniter is secured to the cutting apparatus, it is first attached to a wire line truck (not shown) for electrical testing. If it passes the test, a thermite pellet is loaded into the igniter 8 and it is secured to the other end of the cutting apparatus 10. The entire cutting apparatus 10 is then lowered into the conduit to be cut and positioned within the conduit adjacent to where the conduit is to be cut. Igniting the combustible material within the igniter 8 generates an expanding flow of heated gas that passes into the extension housing 6 and also ignites the combustible material loaded into the extension housing. As the igniter 8 and the extension housing 6 does not expand outward, this forcibly directs the entire flow of heated gas downwards towards the apparatus housing 12. As shown and discussed in more detail below, the movable sleeve 14 is forced by the flow of heated gas through the apparatus housing 12 to reveal a circumferential diverter gap 52 that directs the flow of heated gas to radially project outward from the cutting apparatus 10 to cut from the internal surface through the external surface of the conduit. FIGS. 2 and 2A show an embodiment of the cutting system for radially projecting a flow of heated gas to cut from an internal surface through an external surface of a conduit. The conduit may be for oil, gas, mining, and underwater pressure sealed tool applications. The cutting system is adapted to be positioned within the conduit. The cutting system comprises an igniter 8, an extension housing 6, and an apparatus housing 12. Combustible pellets are not loaded into the apparatus housing 12. The apparatus housing 12 and a movable sleeve section 14, both made from hardened steel. A nozzle assembly 16 within the apparatus housing 12 directs the flow of heated gas through the cutting apparatus 10.

As best understood by comparing FIGS. 1, 2, 2A, 3, and 3A, the apparatus housing 12 is mounted to the extension housing 6 with the threads 34. When the extension housing 6 is screwed into the apparatus housing 12 the end of the extension housing 6 occupies all of the space in the apparatus housing 12 as it butts up against a constricted section 36. The constricted section 36 is smaller in internal diameter than the internal diameter of the extension housing 6, blocking the passage of the combustible materials such as the thermite pellets that are loaded in the extension housing 6. The constricted section 36 supports the combustible materials above the nozzle assembly 16. The flow of heated gas from the extension housing 6 has its pressure increased when it meets the constricted section 36 in the apparatus housing 12. This constricted section 36 in the apparatus housing 12 is made of steel and is not made of carbon or other heat resistant material. When the cutting apparatus 10 is fired and the hot gases begin to flow to the apparatus housing 12, the hot gases impact the inside diameter of the constricted section 36 and within a few milliseconds burn it out allowing a full volume flow of hot gases to pass through the rest of the apparatus housing 12. This brief pause of a few milliseconds gives a pressure boost which is very helpful when cutting conduit below external pressures of 1000 psi. The amount of added pressure that builds in the extension housing 6 can be adjusted by changing the internal diameter of the constricted section 36. The constricted section 36 increases the efficiency of cuts done where well bore external pressures are between zero to 1000 psi but does not hamper cuts done over 1000 psi as the constricted section 36 is quickly burned out by the flow of hot gas allowing full unobstructed flow to occur.

As best understood by comparing FIGS. 2, 2A, 4, 4A, and 4B, a conical head 18 comprises a conical diverter 17 and a jacket 19. The conical diverter 17 disperses the flow of heated gas evenly through the nozzle assembly 16. The jacket 19 that has a plurality of jacket through holes 20 for dispersing the flow of heated gas evenly through the nozzle assembly 16. These jacket through holes 20 increase the pressure and velocity of the flow of heated gas. The conical head 18 also protects the top of the spindle 22 from the effects of the flow of heated gas whose temperature can exceed 5400-degrees F. It has been found that that in situations where more thermite pellets are required to make difficult and challenging pipe cuts the conical head 18 needs to be thicker to protect the spindle 22 from the destructive effects of larger quantities of 5400-degree temperature heated gas flows passing through and impacting the conical head 18. The conical head 18 is mounted to the spindle 22 with the help of a pin (not shown) that fits in the slot 38 and is held in place with the help of an epoxy. The conical head 18 has a length to diameter ratio between 0.43 and 1.5 but it is preferred to have at least a length to diameter ratio greater than 1.0. The conical diverter 17 has an angle of less than 41 degrees but is preferably 31 degrees.

As best understood by comparing FIGS. 2, 2A, 5, 5A, and 5B, a spindle 22 abuts the conical head 18. The spindle 22 comprises a stalk 23 and a sheath 25. The stalk 23 provides structural support for the nozzle assembly 16 and maintains the position of the nozzle assembly 16 in the apparatus housing 12. In this embodiment, the sheath 25 continues the flow path for the flow of heated gas with sheath through holes 24 aligned with the jacket through holes 20 in the conical head 18. The spindle 22 has exterior threads 50 on the sheath 25 that allows it to be mounted to the interior threads 51 of the apparatus housing 12. The spindle 22 has an opening 40 to receive a pin (not shown) that aligns and holds the conical head 18 in place with the help of an epoxy.

Figure 6:
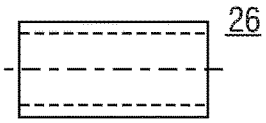
FIG. 6 shows a cross-sectional view of the heat resistant tubing of FIG. 2.
Figure 6A:
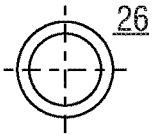
FIG. 6A shows a top view of the heat resistant tubing of FIG. 6.
Figure 7:
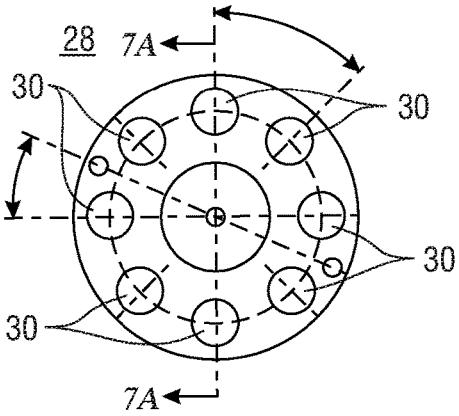
FIG. 7 shows a top view of the retainer of FIG. 2.
Figure 7A:
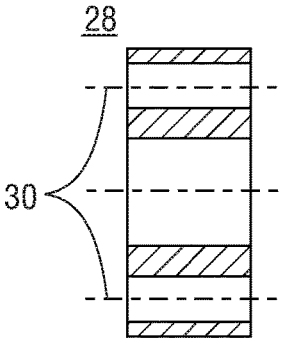
FIG. 7A shows a cross-sectional view of the retainer of FIG. 7.
Figure 8:
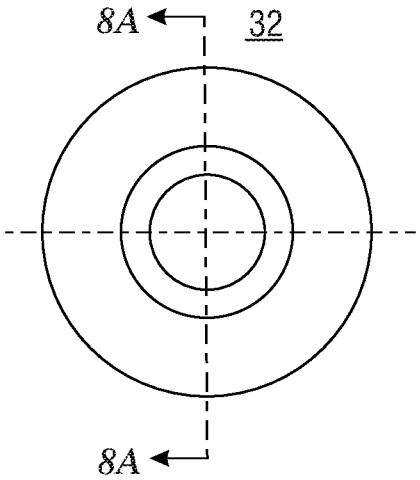
FIG. 8 shows a top view of the diverter of FIG. 2.
Figure 8A:
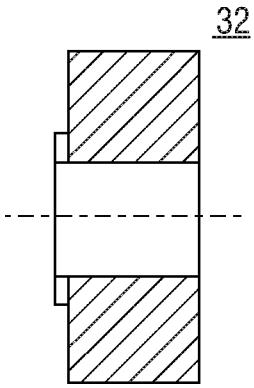
FIG. 8*a* shows a cross-sectional view of the diverter of FIG. 8.

In order to provide adequate structure and support for the nozzle assembly, the spindle 22 must be made of hardened alloy steel. However, hardened steel generally cannot withstand the high temperatures generated by the flow of heated gas, so it is preferred that the sheath through holes 24 are lined with heat resistant tubing 26 (shown, for example in FIGS. 6 and 6A). This heat resistant tubing 26 may be inserted into the spindle through holes 24. This heat resistant tubing 26 protects the spindle 22 from early burnout and failure as the flow of heated gas passes through.

If the spindle 22 fails because of a heat resistant tubing 26 failure, the threads 50 on the spindle 22 and threads 51 on the apparatus housing 12 will be burned away blowing the conical head 18, spindle 22, retainer 28, diverter 32, stem 15, and movable sleeve 14 out the end of the cutting apparatus 10 along with losing any centralizers or pressure balance anchors (see U.S. Pat. No. 5,435,395 Anchor System for Pipe Cutting) that may be attached to the notch on the end of the stem 15. The chances for a successful pipe cut in this situation is much less than 100%. Other situations that arise are partial burnouts in the spindle 22 area as heat resistant tubing 26 begins failing as this will burn through the apparatus housing 12 without blowing out the nozzle assembly 16 parts as described above. These "short circuit" burn-through situations lose high pressure heated gas above the circumferential diverter gap 52 reducing the cut efficiency below 100%. When the hot gas finds another low resistance path through the side of the apparatus housing 12 because of heat resistant tubing 26 failures, this hot gas will no longer travel through all of the retainer through holes 30 with equal and full pressure before it impacts the diverter 32 exiting the circumferential diverter gap 52. This will then leave cutting gaps of varying intensity on the inside of conduit in which the cutting apparatus 10 is installed and a partially severed conduit will remain.

As best understood by comparing FIGS. 2, 2A, 7, and 7A a retainer 28 continues the flow path of the spindle 22 and the conical head 18 with retainer through holes 30 of its own. The retainer 28 surrounds and protects the spindle 22 and the stalk 23. The flow of heated gas passes through the retainer through holes 30 to the rest of the nozzle assembly 16. The retainer is made from heat resistant material and should have a length to width ratio between 0.5 and 0.25 but it is preferred that the length to width ratio be at least 0.3 to protect the spindle 22 from the destructive effects of the flow of heated gas.

As best understood by comparing FIGS. 2, 2A, 8, and 8A, the retainer 28 abuts a diverter 32. The diverter 32 increases the pressure and velocity of the flow of heated gas after the flow of heated gas passes through the retainer 28. The diverter imposes a 90-degree bend in the direction of the flow of the heated gas. This bend creates a perpendicular blockage in the direction of the flow of the heated gas without the use of gentle curves or a radius. The heated gas then flows across the top of the diverter 32 and impacts the inside surface of the movable sleeve 14 where it applies pressure. When that pressure exceeds the external pressure in the conduit that the cutting apparatus 10 is located, the movable sleeve 14 is pushed away from the apparatus housing 12 exposing a circumferential diverter gap 52 through which the flow of heated gas projects radially to perform the cutting function of the cutting system 10.

When the flow of heated gas exists the retainer 28, it impacts the diverter 32 which, contrary to prior art configurations, is set at a 90-degree angle to the through holes 30 from the retainer. This causes the flow of heated gas to impact the flat surface of the diverter 32 and spread much like a jet of water is spread when it is held at a 90-degree angle against a flat surface. There are no gentle curves used in this nozzle assembly 16 as the flow of heated gas suffers the blunt force trauma of hitting a flat surface forcing it to spread. This spreading of the flame on the flat surface of the diverter 32 greatly enhances movement of the movable sleeve 14 (shown in FIGS. 10 and 10A) against the stem 15 (shown on FIGS. 9 and 9A) creating the circumferential diverter gap from which the flow of heated gas exits and impacts the inner surface of the conduit in which the cutting system 10 is inserted to be cut.

The flat diverter 32 is superior to cutting systems that utilize a curved diverter or a diverter that utilizes a gentle radius which gently bends the stream of heated gas such as seen in U.S. Pat. Nos. 4,598,769, 6,186,226, and in U.S. Pat. Nos. 9,677,364 & 9,677,365. A flat diverter is very disruptive of the flame flow causing it to spread making for better pipe cuts.

Figure 9:
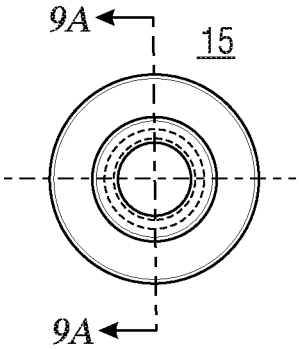
FIG. 9 shows a top view of the stem of FIG. 2.
Figure 9A:
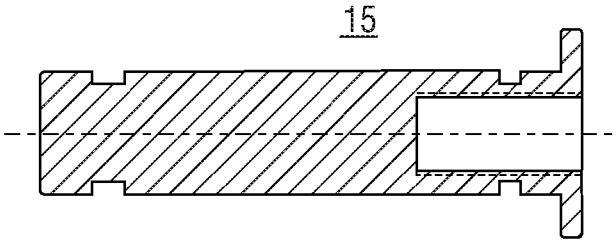
FIG. 9A shows a cross-sectional view of the stem of FIG. 9.

FIGS. 9 and 9A show the stem 15 which provides structure to the nozzle assembly 16 and directly supports the diverter while maintaining the position of the nozzle assembly 16 in the cutting system 10. The stem allows the attachment of a pressure balance anchor (U.S. Pat. No. 5,435,394), if needed.

Figure 10:
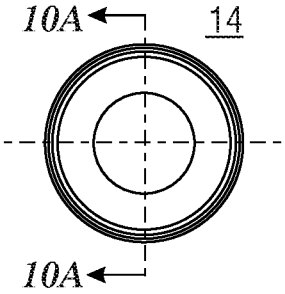
FIG. 10 shows a top view of the movable sleeve of FIG. 2.
Figure 10A:
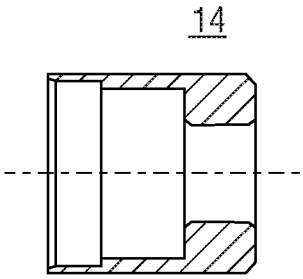
FIG. 10A shows a cross-sectional view of the movable sleeve of FIG. 10.

FIGS. 10 and 10A show the movable sleeve 14. O-rings 56 are attached on the ends of the apparatus housing 12 and the movable sleeve 14 is pushed onto the end of the apparatus housing 12 completing the assembly of the cutting system 10. Because it is necessary to make the movable sleeve 14 thinner in the area of the circumferential gap 52, the movable sleeve 14 must be made of an exceptionally good alloy steel hardened to a great degree. The apparatus housing 12 has threads 51 at the movable sleeve end. This allows for the use of steel spindles 22 with heat resistant tubing 26 and exterior threads 50 on the sheath 25. These embodiments of apparatus housings 12 are weaker because of these threads 51. As external well pressures increase warpage of the apparatus housing 12 will occur causing the movable sleeve 14 to begin to bind on the end of the apparatus housing 12. Other embodiments of cutting systems described herein use no threads in this area and can take many more thousands of psi of external well pressures before warpage occurs.

The various components of the cutting system 10 shown in FIG. 1, the igniter 8, an extension housing 6, and the apparatus housing 12, are preferentially made of hardened steel for strength and durability. The extension housing 6 can be made of a lower grade steel such as 1026 while the apparatus housing 12, spindle 22, sheath 25, stalk 23, and stem 15 should be made of a 4140-grade steel, a 4340-grade steel, or better to prevent distortion.

However, the heat generated by igniting thermite pellets is high enough to damage and destroy hardened steel therefor other heat resistant materials must be used particularly in those areas where the flow path of heated gas is constricted or in those areas that are needed to survive in order to get good pipe cuts. However, the entire cutting system cannot simply be constructed from heat resistant material because typical heat resistant materials, such as refractory metals and their alloys, do not have the strength characteristics of hardened steel and are typically much more expensive to machine and produce.

For the conical heads 18, retainers 28, diverters 32, and heat resistant tubing 26, the preferred heat resistant material is graphite, both high density and low density, in low pressure well bore situations up to 4,000 psi.

The flat diverter 32 takes a terrible pounding from the direct action of the hot highpressure gas when the diverter 32 turns the flame 90 degrees. As the external well pressures rise in a well, combustible pyrotechnic materials that have faster pressure rise times must be used. Pressure rise time is defined as the rate of pressure rise in pounds per square inch per second of elapsed time. As the pressure rise time increases the mechanical and thermal shock load on the carbon increases the fracture risk. On the cutting system 10 shown in FIG. 2, the retainer 28 is surrounded and supported on all sides by the apparatus housing 12 and can withstand higher thermal shocks but the flat diverter 32 cannot. Other materials could be used for this purpose, including any of the refractory metals (niobium, molybdenum, tantalum, tungsten, and rhenium) and their alloys. These materials have excellent thermal and structural properties at higher temperatures but are difficult to work with and to fabricate parts and are costlier. They are used for retainers 28 and diverters 32 and to produce nozzle assemblies 16 with greater burnout and fracture resistance at well bore pressures of to 15,000 psi or more.

Epoxy or high temperature sealant may be used to seal the internal components of the cutting apparatus 10. While this may serve to hold the components of the cutting apparatus 10 together, the primary purpose is to fill up any loose space between various components and to allow for the buildup of pressure within the cutting apparatus 10 during the cutting process.

Figure 11:
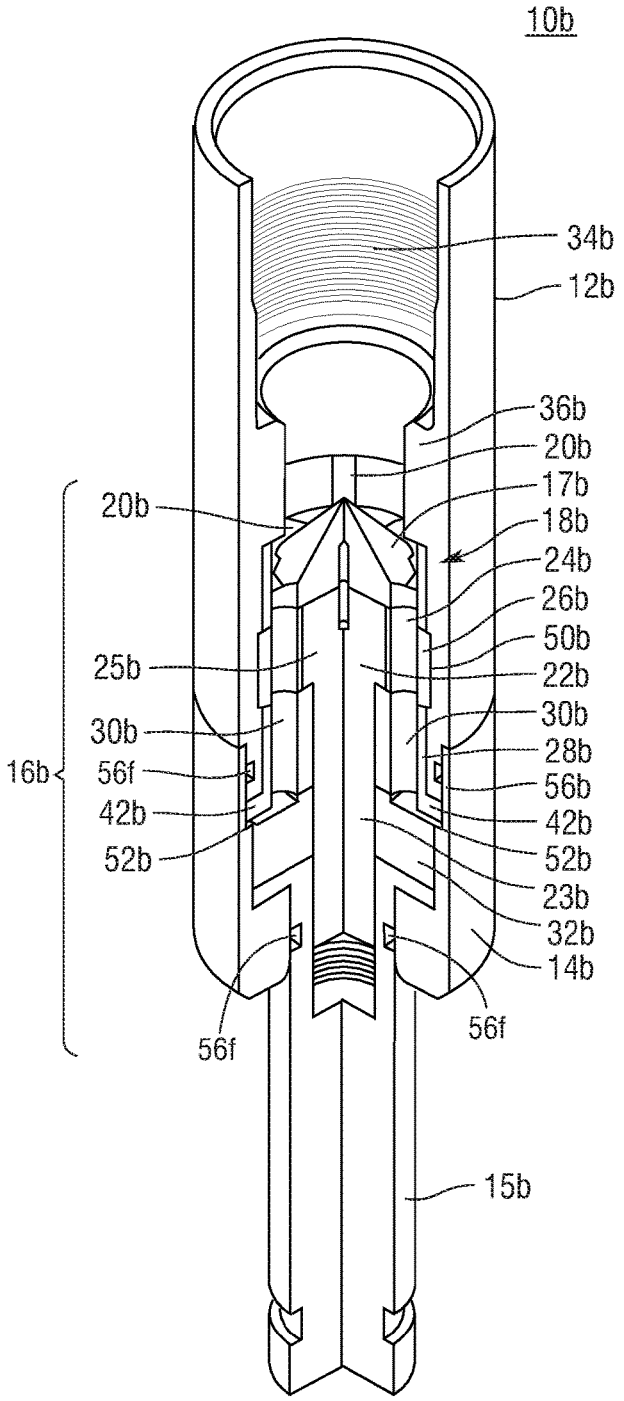
FIG. 11 shows a perspective cut-out view of another embodiment of an apparatus housing for a cutting apparatus for radially projecting a flow of heated gas in which the retainer has a lip that protects the apparatus housing at the circumferential diverter gap.
Figure 12:
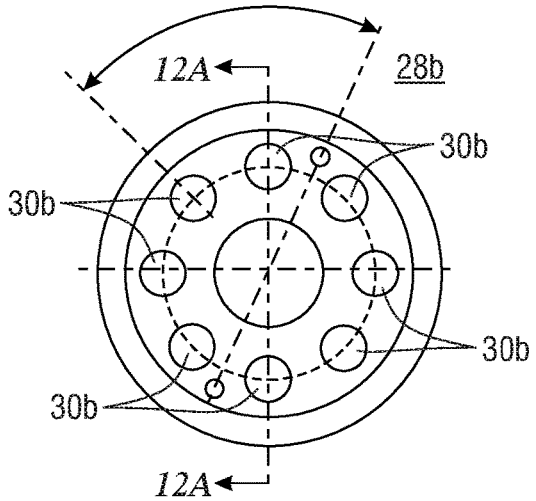
FIG. 12 shows a top view of the retainer of FIG. 11 having a lip that protects the apparatus housing at the circumferential diverter gap.
Figure 12A:
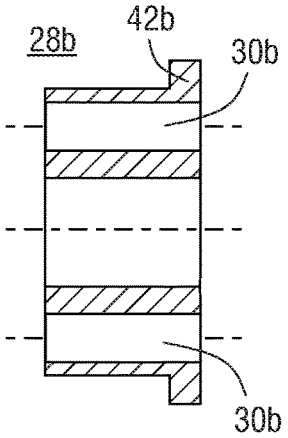
FIG. 12A is a cross-sectional view of the retainer of FIG. 12A.

FIG. 11 shows an embodiment of cutting apparatus 10*b* in which additional protection is provided to the apparatus housing 12*b* at the circumferential diverter gap 52*b* that is created when the cutting apparatus 10*b* is in operation. As can be seen by comparing FIGS. 11, 12, and 12A, in this embodiment, the retainer 28*b* incorporates a lip 42*b* that extends under the bottom portion of the apparatus housing 12*b* between the apparatus housing 12*b* and the diverter 32*b*. The lip 42*b* protects the end of the apparatus housing 12*b* from being eroded away by the flow of hot gas as it exits the circumferential diverter gap 52*b*. In addition, after the initial surge of hot gases passes through the retainer 28*b* and impacts the diverter 32*b*, a lot of turbulence is created before sufficient pressure is built up to move the movable sleeve 14 out of the way to create the circumferential diverter gap 52*b*. The lip 42*b* provides additional protection to the apparatus housing 12*b* during this period. This increases the cutting action of the cutting apparatus 10*b* because the heat resistant lip 42*b* channels more of the flow of hot gas that has been spread by the flat diverter 32*b* to the target pipe rather than wasting energy burning away the lower end of the apparatus housing 12*b*. The other features of this embodiment are similar to those described elsewhere with other embodiments.

Figure 13:
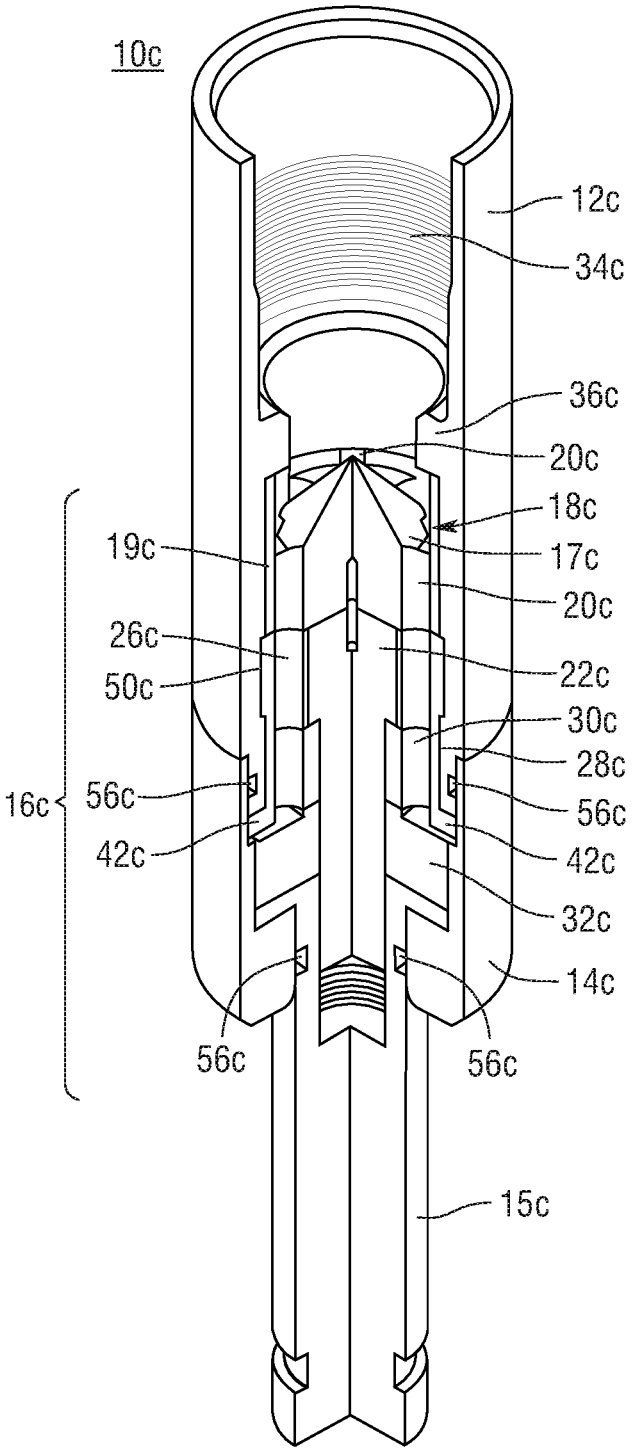
FIG. 13 shows a perspective cut-out view of another embodiment of an apparatus housing for a cutting apparatus for radially projecting a flow of heated gas having an extended conical head.
Figure 14:
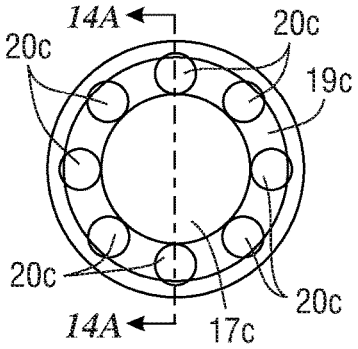
FIG. 14 shows a top view of the conical head of FIG. 13 that is extended to provide additional heat protection to the spindle.
Figure 14A:
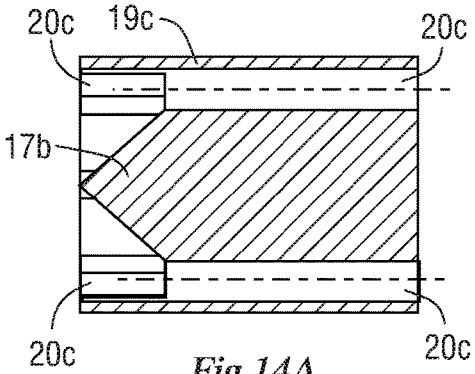
FIG. 14A is a cross-sectional view of the conical head of FIG. 14.
Figure 14B:
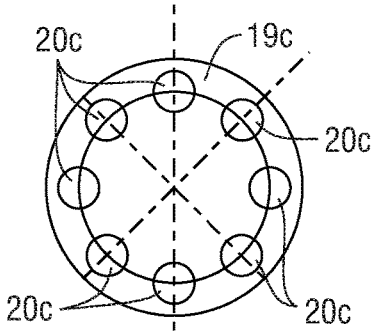
FIG. 14B is a bottom view of the conical head of FIG. 14.

FIG. 13 shows another embodiment of cutting apparatus 10*c* in which the conical head 18*c* is expanded to increase the heat resistance protection provided to the spindle 22*c*. This is especially important when using high-density thermite pellets that contain no loose powder as the flow of heated gas shoots down the tunnel area of the pellets where it directly impacts the conical diverter 17*c* with extraordinary velocity, power, pressure and heat and is directed to the jacket 19*c* and the jacket through holes 20*c*. In these situations, the ratio of the length to the diameter of the conical head 18*c* should be greater than 1. FIGS. 14, 14A, and 14B, show a conical head 18*c* having a 1.31 ratio of length to diameter. This longer conical head 18*c* enhances the insulating effect between the conical head 18*c* and the top of the spindle 22*c* which is necessary when using larger quantities of thermite. The additional insulation furnished by the longer conical head 18*c* prevents the spindle 22*c* from overheating where it would cause early burnout and failure.

In this embodiment, the spindle 22*c* has heat resistant tubing 26*c* in the spindle through holes 24*c*. The spindle through holes 24*c* align with the retainer through holes 30*c* in the retainer 28*c*. In the embodiment depicted, additional protection is provided to the apparatus housing 12*c* at the circumferential diverter gap 52*c* that is created when the cutting apparatus 10*c* is in operation. Like the embodiment shown in FIGS. 11, 12, and 12A, in this embodiment, the retainer 28*c* incorporates a lip 42*c* that extends under the bottom portion of the apparatus housing 12*c* between the apparatus housing 12*c* and the diverter 32*c*. The lip 42*c* protects the end of the apparatus housing 12*c* from being eroded away by the flow of hot gas as it exits the circumferential diverter gap. This increases the cutting action of the cutting apparatus 10*c* because the heat resistant lip 42*c* channels more of the flow of hot gas that has been spread by the flat diverter 32*c* to the target pipe rather than wasting energy burning away the lower end of the apparatus housing 12*c*. The other features of this embodiment are similar to those described elsewhere with other embodiments.

Figure 15:
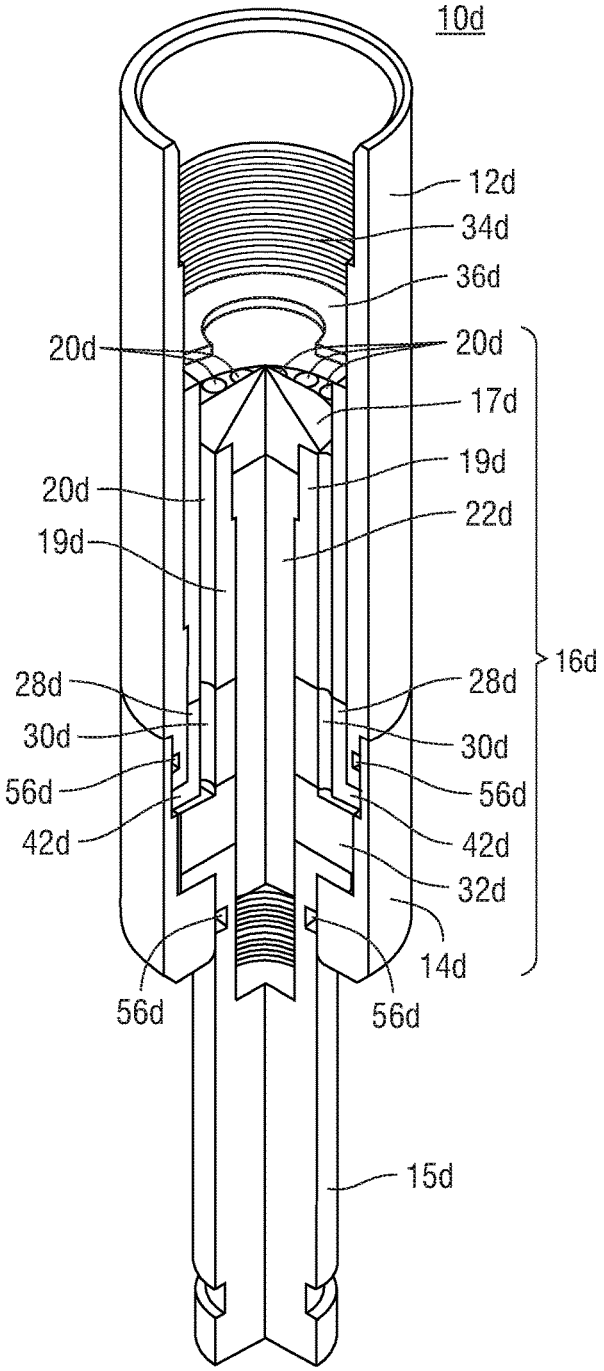
FIG. 15 shows a perspective cut-out view of another embodiment of an apparatus housing for a cutting apparatus for radially projecting a flow of heated gas.

FIG. 15 shows another version of the cutting system 10*d* in which the constricted section 36*d* is a steel washer. As with earlier embodiments, when the cutting apparatus 10*d* is fired and the hot gases begin to flow to the apparatus housing 12*d*, the hot gases impact the inside diameter of the constricted section 36*d* and within a few milliseconds burn it out allowing a full volume flow of hot gases to pass through the rest of the apparatus housing 12*d*. This brief pause of a few milliseconds gives a pressure boost which is very helpful when cutting conduit below external pressures of 1000 psi. The amount of added pressure can be adjusted by changing the internal diameter of the constricted section 36*d*. The constricted section 36*d* increases the efficiency of cuts done where well bore external pressures are between zero to 1000 psi but does not hamper cuts done over 1000 psi as the constricted section 36*d* is quickly burned out by the flow of hot gas allowing full unobstructed flow to occur.

Figure 16:
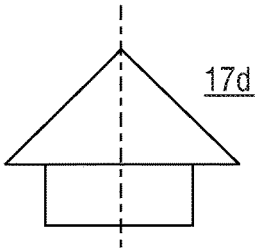
FIG. 16 is a side view of the conical diverter of FIG. 15.
Figure 17:
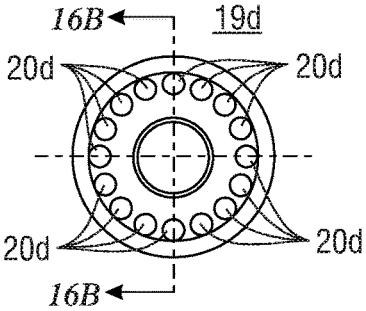
FIG. 17 shows a top view of the jacket of FIG. 15.
Figure 17A:
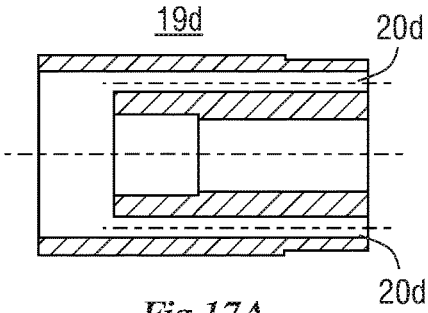
FIG. 17A is a cross-sectional view of the jacket of FIG. 17.
Figure 17B:
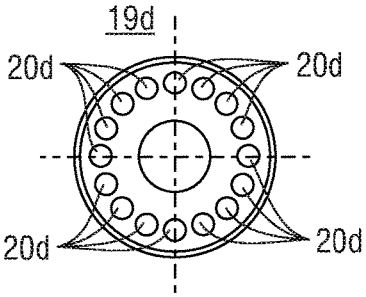
FIG. 17B is a bottom view of the jacket of FIG. 17.
Figure 18:
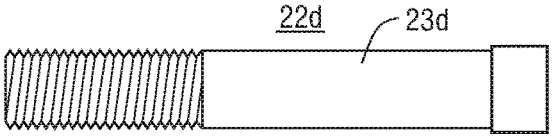
FIG. 18 is a side view of the stalk of FIG. 15.

The conical head 18*d* in this embodiment is in two parts: a separate conical diverter 17*d* (as can be seen in FIG. 16) that sits above the spindle 22*d* and a separate jacket 19*d* that surrounds both the spindle 22*d* and the conical diverter 17*d*. As shown in FIGS. 17, 17A, and 17B, the jacket 19*d* has a plurality of jacket through holes 20*d*. The conical diverter 17*d* disperses the flow of heated gas evenly through the nozzle assembly 16*d* through the jacket through holes 20*d* which increase the pressure and velocity of the flow of heated gas. The spindle 22*d* (also shown in FIG. 18) provides structural support for the nozzle assembly 16*d* and maintains the position of the nozzle assembly 16*d* in the apparatus housing 12*d*. In this embodiment, the spindle does not have a sheath of the earlier embodiments and is limited to a stalk 23*d* onto which the stem 15*d* is mounted.

Figure 19:
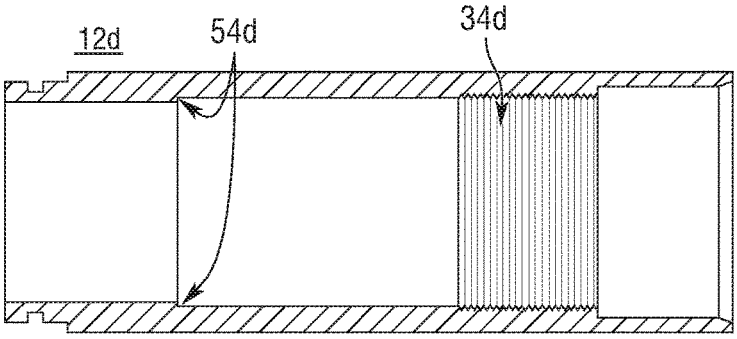
FIG. 19 is a cross sectional view of the apparatus housing of FIG. 15.

As shown in FIG. 19, the apparatus housing 12*d* in this embodiment has an internal lip 54*d*. Tightening the stem 15*d* upon the threads of the stalk 23*d* of the spindle 22*d* forces the diverter 32*d* against the retainer 28*d* which jams the lip of the retainer 42*d* up against the apparatus housing 12*d* and pulls the jacket 19*d* solidly against the internal lip 54*d* in the apparatus housing 12*d* locking the nozzle assembly 16*d* mechanically in place. O-rings 56*d* are attached on the ends of the apparatus housing 12*d* and the movable sleeve 14*d* is pushed onto the end of the apparatus housing 12*d* completing the assembly of the cutting system 10*d*.

The jacket through holes 20*d* transition to the retainer through holes 30*d* in the retainer 28*d*. In the embodiment depicted, additional protection is provided to the apparatus housing 12*d* at the circumferential diverter gap 52*d* that is created when the cutting apparatus 10*d* is in operation. Like some earlier embodiments, in this embodiment, the retainer 28*d* incorporates a lip 42*d* that extends under the bottom portion of the apparatus housing 12*d* between the apparatus housing 12*d* and the diverter 32*d*. The lip 42*d* protects the end of the apparatus housing 12*d* from being eroded away by the flow of hot gas as it exits the circumferential diverter gap 52*d*. This increases the cutting action of the cutting apparatus 10*d* because the heat resistant lip 42*d* channels more of the flow of hot gas that has been spread by the flat diverter 32*d* to the target pipe rather than wasting energy burning away the lower end of the apparatus housing 12*d*.

In this embodiment, high temperature epoxy such as Permatex Red RTV or equivalent high temperature epoxies/sealers are coated on the outside surfaces of both the jacket 19*d* and the retainer 28*d* to seal these parts to the apparatus housing 12*d*. This limits the flow of heated gas to the jacket through holes 20*d* and the retainer through holes 30*d*. The conical diverter 17*d* is epoxied to the top of the jacket 19*d* and the spindle 22*d* which is then epoxied or press fitted to the jacket 19*d*. As with earlier embodiments, while this may serve to hold the components of the cutting apparatus 10*d* together, the primary purpose is to fill up any loose space between various components and to allow for the buildup of pressure within the cutting apparatus 10*d* during the cutting process. The other features of this embodiment are similar to those described elsewhere with other embodiments.

Figure 20:
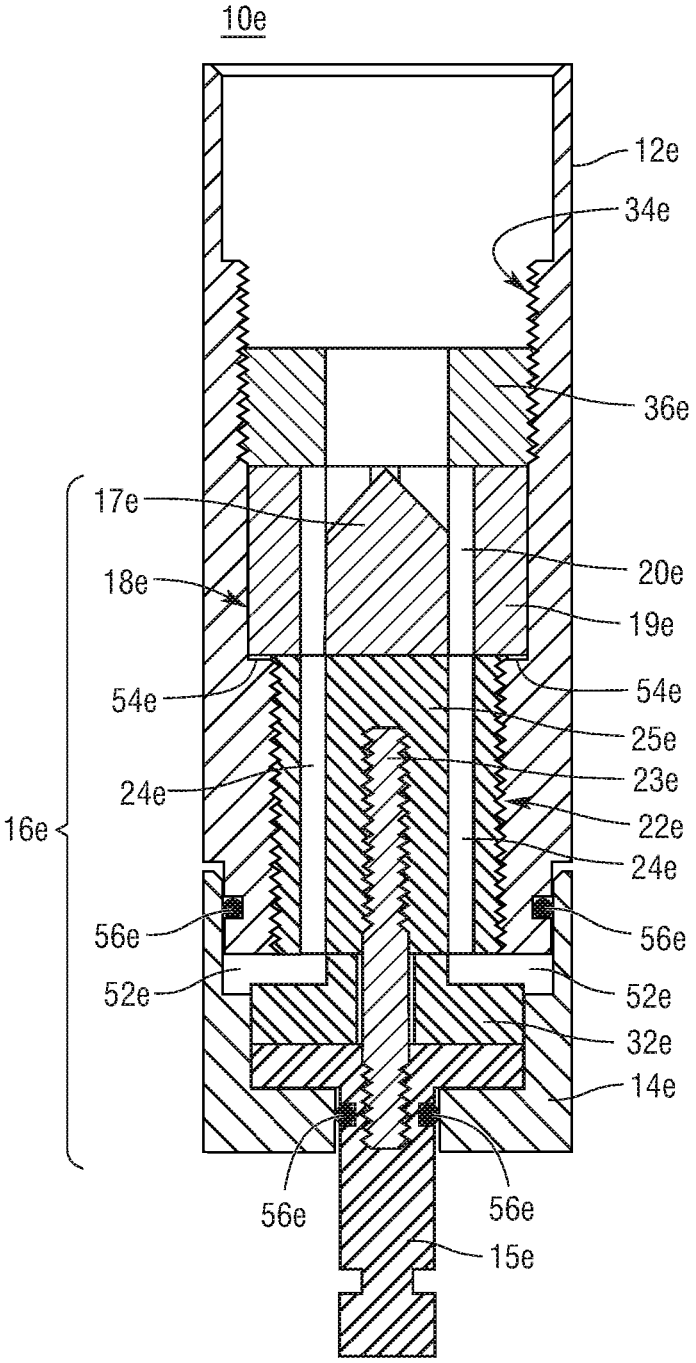
FIG. 20 is a cross sectional view of another embodiment of an apparatus housing for a cutting apparatus for radially projecting a flow of heated gas.
Figure 21:
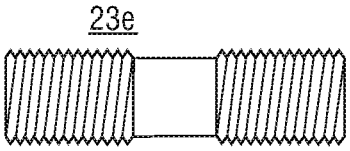
FIG. 21 is a side view of the stalk of FIG. 20.
Figure 22:
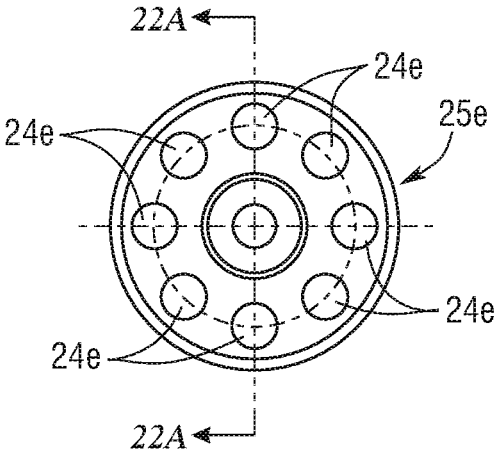
FIG. 22 is a top view of the sheath of FIG. 20.
Figure 22A:
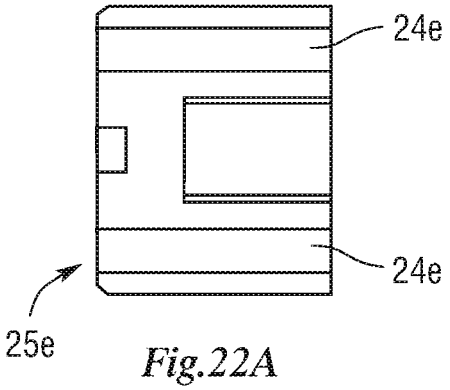
FIG. 22A is a cross sectional view of the sheath of FIG. 22.

FIG. 20 shows another embodiment of the cutting system 10*e* assembly in which the spindle 22*e* comprises two separate pieces for the stalk 23*e* (shown in more detail in FIG. 21) and the sheath 25*e* (shown in more detail in FIGS. 22, and 22A). The sheath 25*e* is preferably a solid piece of refractory metal which means that this embodiment of cutting system 10*e* has no need of heat resistant tubing in the sheath 25*e*. This also means that hot gases have to burn through much more heat resistant material before they reach the steel of the apparatus housing 12*e*. This makes these embodiments much more burn out proof than those embodiments in which the spindles whose sheath through holes have been lined with heat resistant material. This embodiment does not require a separate retainer.

The stalk 23*e* of the steel spindle 22*e* shown in FIG. 21 is screwed into the refractory metal jacket 25*e*, the diverter 32*e* then slides onto the stalk 23*e* and the stem 15*e* is tightened onto the spindle stalk 23*e*. O-rings 56*e* are attached on the ends of the apparatus housing 12*e* and the movable sleeve 14*e* is pushed onto the end of the apparatus housing 12*e* completing the assembly of the cutting system 10*e*.

Figure 23:
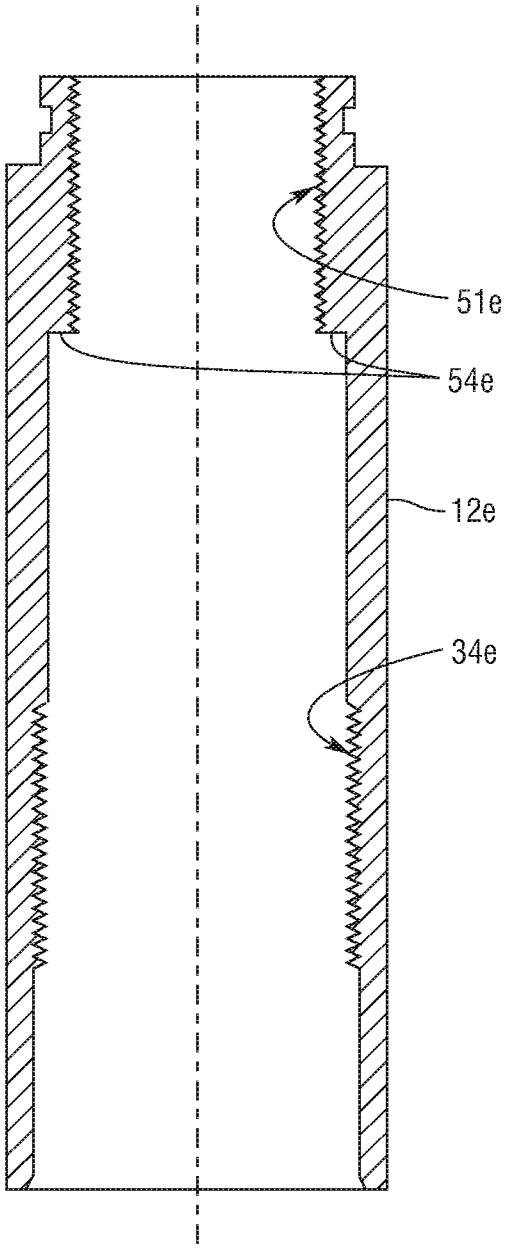
FIG. 23 is a cross sectional view of the apparatus housing of FIG. 20.

The apparatus housing 12*e* (shown in more detail in FIG. 23) has a larger interior diameter at one end that creates an internal lip 54*e*. This allows this embodiment to accommodate a conical head 18*e* (shown in more detail in FIGS. 24, 24A, and 24B) that is larger in outside diameter than the outside diameter of the sheath 25*e* of the spindle 22*e*. The conical head 18*e* has a wider conical diverter 17*e* and a much thicker side wall from the outside edge of the jacket through holes 20*e* to the outside diameter.

It was found by much testing that existing conical heads found in prior art U.S. Pat. Nos. 4,598,769, 6,186,226, 9,677,364 & 9,677,365 and as shown in other embodiments systems tend to burn out in the thin side wall area of the through holes when passing large quantities of hot gas. When this happens the steel apparatus housing comes in direct contact with high velocity hot gas and quickly burns through the side wall. This loss in gas pressure and volume reduces the gas flow that should be traveling through the circumferential gap, so cuts are often less than 100% when loading maximum loads of combustible pellets or when using combustible pellets with burn times above 300,000 psi/sec. By machining a larger diameter on the inside of the nozzle housing 12*e*, conical heads 18*e* that are larger in outside diameter than the outside diameter of the sheath 25*e* of the spindle 22*e* can be used.

These larger outside diameter, thicker walled conical heads 18*e* are much more robust in the jacket through holes 20*e* and are better able to resist burnout under all circumstances. This cutting system 10*e* construction using larger diameter conical heads 18*e* is not possible under the prior art systems where the nozzle housing and the extension housing are one.

Figure 25:
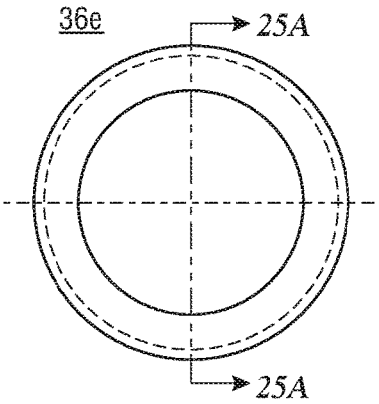
FIG. 25 is a top view of the constricted section of FIG. 20.
Figure 25A:
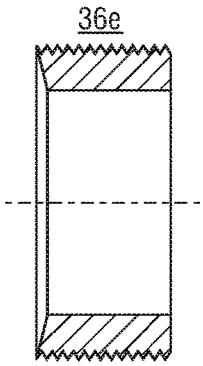
FIG. 25A is a cross sectional view of the constricted section of FIG. 25.

As best understood by comparing FIGS. 20, 25, and 25A, the constricted section 36*e* in this embodiment is a steel retaining nut. The constricted section 36*e* holds the conical head 18*e* tightly against the sheath 25*e*. As with other embodiments, this constricted section 36*e* butts up against the extension housing when the cutting system 10*e* is assembled and has an opening through the center that is smaller than the inside diameter of the extension housing which serves to block the passage of the combustible pellets that are typically 0.010 inch smaller than the inside diameter of the extension housing. The opening in the constricted section 36*e* is smaller in inside diameter than the inside diameter of the extension housing momentarily increasing the pressure, and velocity of the hot gas as it passes through on its way to the conical head 18*e*. The constricted section 36*e* quickly burns out to the inside diameter of the extension housing in a few milliseconds allowing the full flow of hot gas to pass through to the conical head 18*e*. Since the pressure and velocity of the burning combustible pellets take a few milliseconds to reach a maximum value, the constricted section 36*e* increases the pressure/velocity of the gas that hits the conical head 18*e* at the very beginning of the burn but as the combustible pellets increase their pressure/velocity later in the burn the steel of the constricted section 36*e* has burned away directing the full flow of gas into the jacket through holes 20*e* making a more steady burn.

The major advantage of the steel retaining nut is the constricted section 36*e* increases the cutting ability of the cutting system 10*e* at external well bore pressures below 1000 psi. It does this because at low external well bore pressures the combustible pellets have not totally combusted before hot gas exits the circumferential gap 52*e* and starts to cut the conduit. Therefore, by providing some additional back-pressure through the use of constricted section 36*e*, cutting can begin further up on the pressure rise time curve (described earlier). The other features of this embodiment are similar to those described elsewhere with other embodiments.

Figure 26:
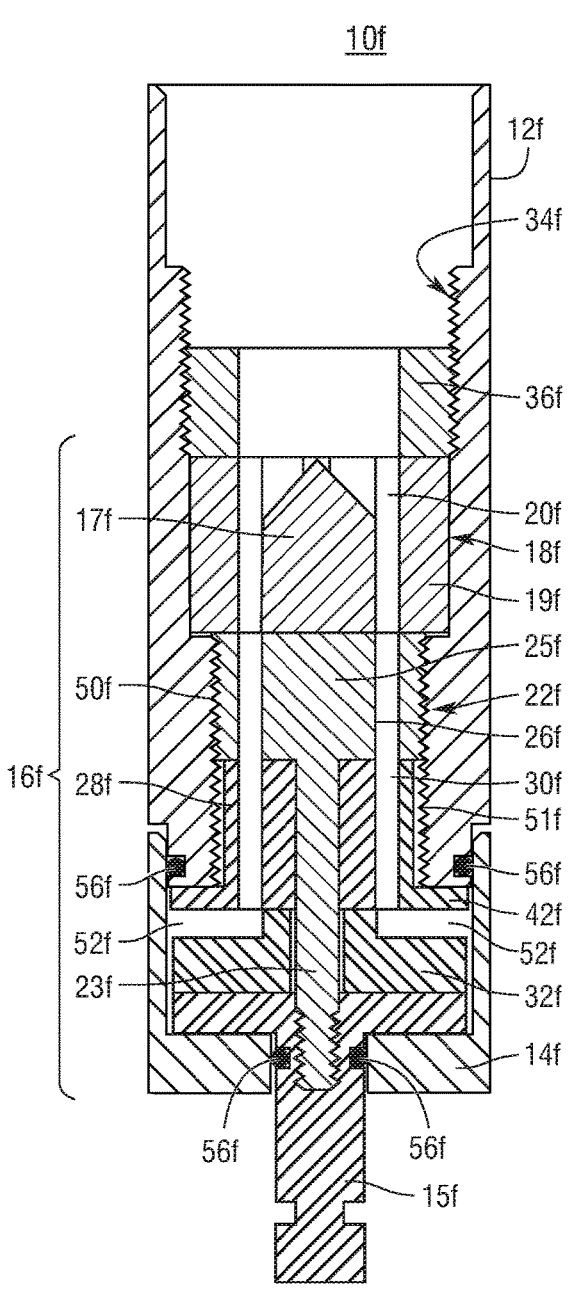
FIG. 26 is a cross sectional view of another embodiment an apparatus housing for a cutting apparatus for radially projecting a flow of heated gas.

FIG. 26 shows another embodiment of cutting system 10*f*. In this embodiment, the apparatus housing 12*f* is similar to the embodiment shown in FIG. 23. The spindle 22*f* is attached by screw threads 50*f* on the exterior of the sheath 25*f* to the screw threads 51*f* on the interior of the apparatus housing 12*f*. This embodiment uses a retainer 28*f* with a lip 42*f*. The apparatus housing 12*f* has an internal lip 54*f* that allows a larger outside diameter and length conical head 18*f* and the constricted section 36*f* is a steel retaining nut. The other features of this embodiment are similar to those described elsewhere with other embodiments.

Figure 24:
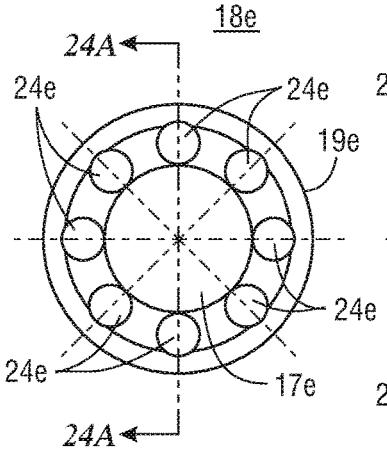
FIG. 24 is a top view of the conical head of FIG. 20.
Figure 24A:
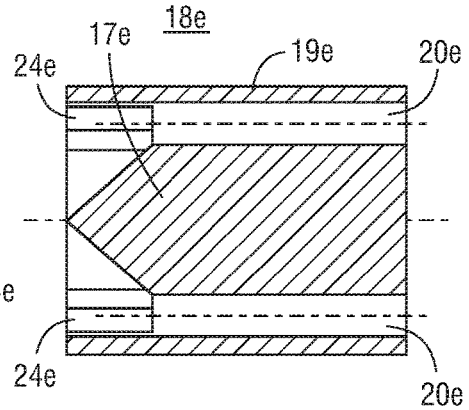
FIG. 24A is a cross sectional view of the conical head of FIG. 24.
Figure 24B:
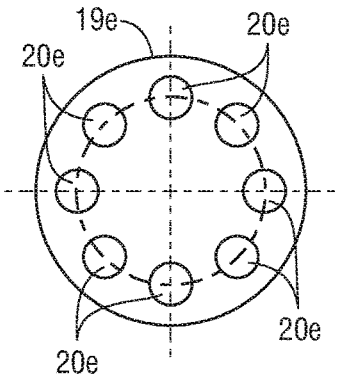
FIG. 24B is a bottom view of the conical head of FIG. 24.
Figure 27:
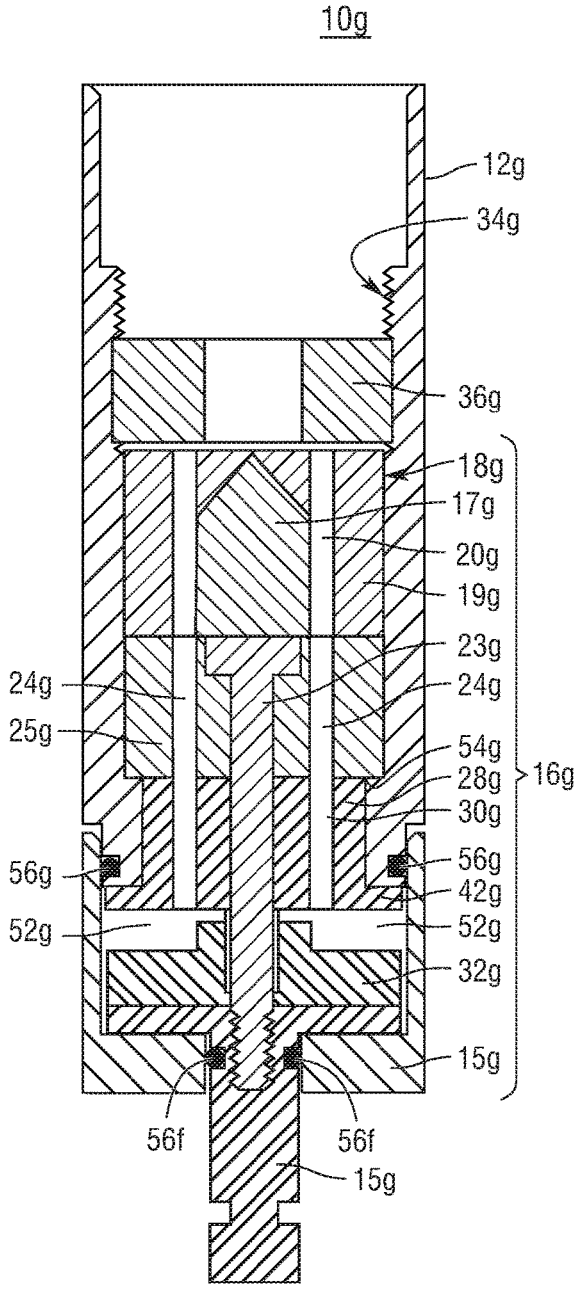
FIG. 27 is a cross sectional view of another embodiment of an apparatus housing for a cutting apparatus for radially projecting a flow of heated gas.
Figure 28:
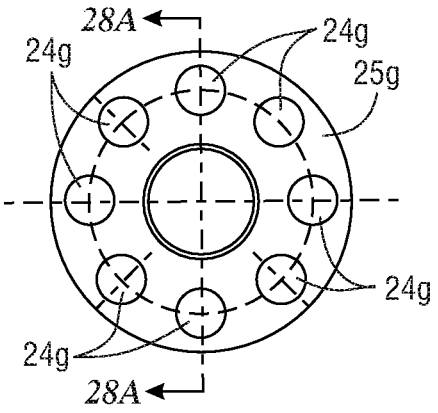
FIG. 28 is a top view of the sheath of FIG. 27.
Figure 28A:
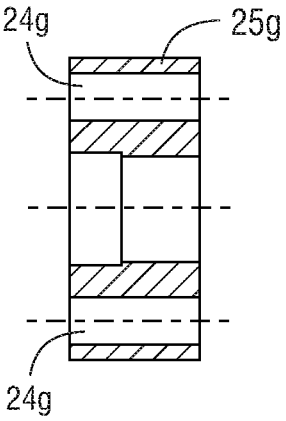
FIG. 28A is a cross sectional view of the sheath of FIG. 28.
Figure 28B:
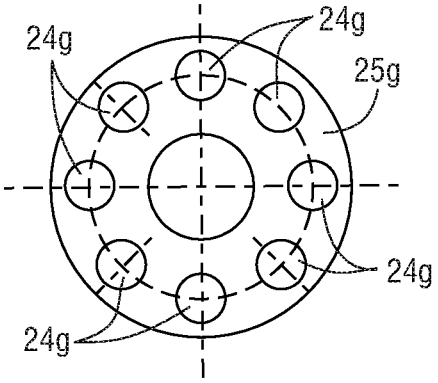
FIG. 28B is a bottom view of the sheath of FIG. 28.

FIG. 27 shows another embodiment of cutting system 10*g* in which the conical head 18*g* is similar to the one shown in FIGS. 24, 24A, and 24B. The conical head 18*g* sits above a spindle 22*g* that comprises two separate components of a stalk 23*g* that is similar to the one shown in FIG. 18 and a sheath 25*g* that is shown in FIGS. 28, 28A, and 28B. The sheath 25*g* is made of a refractory metal that has a plurality of sheath through holes 24*g*.

The spindle 22*g* provides structural support for the nozzle assembly 16*g* and maintains the position of the nozzle assembly 16*g* in the apparatus housing 12*g* by clamping the sheath 25*g* against the interior lip 54*g* of the apparatus housing 12*g* (similar to the one shown in FIG. 19) by the action of pulling the lip 42*g* of the retainer 28*g* against the end of the apparatus housing 12*g*. This happens as a result of the stem 15*g* tightening upon the threads of the stalk 23*g* and forcing the refractory metal diverter 32*g* against the refractory metal retainer 28*g* which jams the lip 42*g* up against the end of the apparatus housing 12*g* pulling the sheath 25*g* solidly against the internal lip 54*g* in the apparatus housing 12*g* and locking the nozzle assembly 16*g* mechanically in place. The other features of this embodiment are similar to those described elsewhere with other embodiments.

Figure 29:
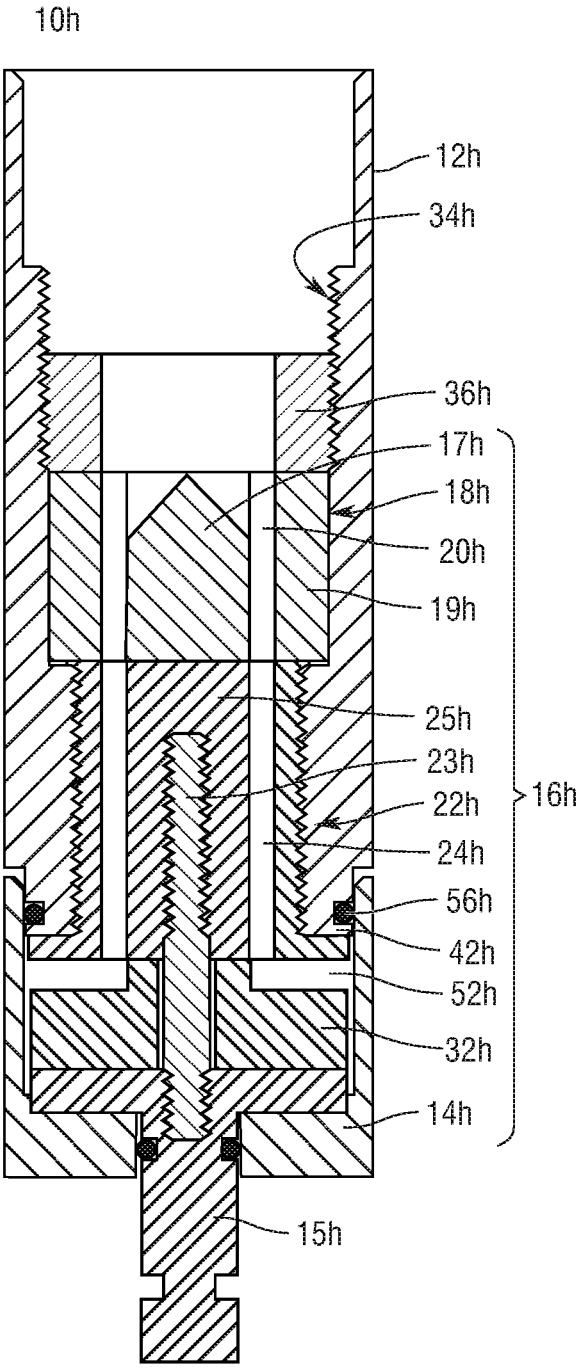
FIG. 29 is a cross sectional view of another embodiment an apparatus housing for a cutting apparatus for radially projecting a flow of heated gas.
Figure 30:
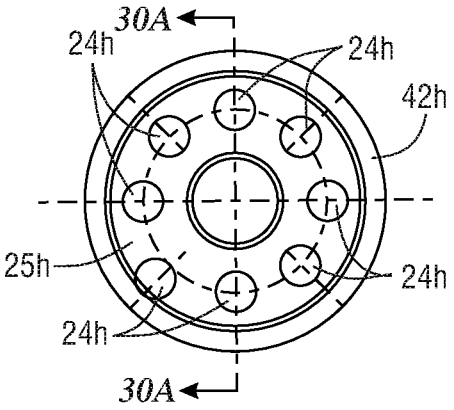
FIG. 30 is a top view of the sheath of FIG. 29.
Figure 30A:
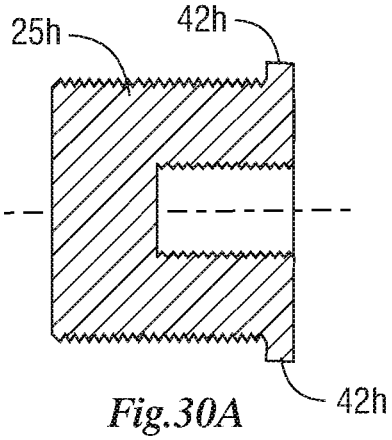
FIG. 30A is a cross sectional view of the sheath of FIG. 30.

The embodiment of the cutting system 10*h* shown in FIG. 29 is similar to the one shown and discussed above with FIG. 20 with the exception that sheath 25*h*, which serves as a retainer in this embodiment, has a lip 42*h* shown in more detail in FIGS. 30 and 30A. This solid piece of refractory metal sheath 25*h* with the lip 42*h* has no need of heat resistant tubing, this means the hot gases have to burn through much more heat resistant material before they reach the steel of the nozzle housing 12*h*. The lip 42*h* keeps the end of the nozzle housing 12*h* from burning away. The other features of this embodiment are similar to those described elsewhere with other embodiments.

Embodiments, such as that shown in FIGS. 15 and 27, that attach the nozzle assembly 16*d*, 16*g* to the apparatus housing 12*d*, 12*g* with a clamping action rather than the traditional threaded connection make for superior cutting tools for several reasons. The assembly housings 12*d*, 12*g* (shown for example in FIG. 19) are much stronger because there are no threads around the internal lip 54*d*, 54*g*. In tests conducted under pressures typically encountered in oil and gas wells, with all other factors remaining equal, the apparatus housings with internal threads will warp before the apparatus housings without threads. This warping will bind the movable sleeve to the apparatus housing causing the hot gases to burn through the movable sleeve before they reach the conduit to be cut. This action produces inferior pipe cuts of less than 100% because energy is wasted burning through the movable sleeve.

Nozzle assemblies 16*d*, 16*g* that have a jacket 19*d* as shown in FIGS. 15, 17, 17A, and 17B, and that have a jacket 19*g* and sheath 25*g* as shown in FIGS. 27, 28, 28A, and 28B that clamp in the apparatus housing 12*d*, 12*g*, have superior heat resistance to the flow of hot gases over spindle designs that are threaded and use heat resistant tubing such as nozzle assemblies 16, 16*b*, 16*c*, 16*e*, 16*f*, and 16*h* (shown in FIGS. 2, 11, 13, and 26) that have spindles 22, 22*b*, 22*c*, 22*e*, 22*f*, and 22*h* that have sheaths 25, 25*b*, 25*c*, 25*e*, 25*f*, and 25*h* that are threaded to the interior of the apparatus housing 12, 12*b*, 12*c*, 12*e*, 12*f*, and 12*h*. The sheath through holes 24, 24*b*, 24*c*, and 24*f* are lined with heat resistant tubing 26, 26*b*, 26*c*, and 26*f*. This is a compromise between drilling larger diameter through holes in the sheaths which weakens the spindles and using heat resistant tubing that has thicker side walls that would have greater resistance to burnout. Embodiments of nozzle assemblies 16*e*, 16*h* in which the spindles 22*e*, 22*h* are two-pieces sheaths 25*e*, 25*h* (as shown in FIGS. 20, 22, 22A, 29, 30, and 30A) using solid refractory metal from the outside edge of the through holes to the outside edge of the threads are superior to the spindle designs that use heat resistant tubing.

Because the cutting apparatus embodiments disclosed herein allow for a relatively short assembly housing, this enables the creation of the interior lip 54*d*, 54*g* in the apparatus housing 12*d*, 12*g* which makes the apparatus housing 12*d*, 12*g* wider in the area above the interior lip 54*d*, 54*g*. This means that the jacket 19*d*, 19*g* (and the sheath 25*g*) in those embodiments can be larger in outside diameter. This fact and the lack threads on these components makes it all the more difficult for the hot gases to burn through the outside edge of the jacket through holes 20*d*, 20*g* where hot gases can burn through the apparatus housing 12*d*, 12*g*. If hot gases burn through the conical head, jacket, or sheath of any embodiment, this reduces the flow of hot gases that flow through the circumferential diverter gap causing a less than 100% cut. In these situations, depending upon the degree of burnout through and around these components, the entire nozzle assembly could fail blowing out the bottom of the cutting apparatus and taking any centralizers or pressure balance anchors with it. Repeated testing of various embodiments has shown, that embodiments such as those shown in FIGS. 15 and 27 are more resistant to burn out which allows these embodiments to cut conduit with less combustible material and to make cleaner cuts. In all other designs, burnout in the area of the smaller outside diameter conical heads and heat resistant tubing lined spindles divert energy away from the cut.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. An apparatus housing for a cutting system for radially projecting a flow of heated gas to cut from an internal surface through an external surface of a conduit, the cutting system adapted to be positioned within the conduit, said cutting system comprising an igniter, an extension housing, and the apparatus housing, combustible pellets are not loaded into the apparatus housing, and the apparatus housing comprising:

a movable sleeve; and a nozzle assembly within said apparatus housing, said nozzle assembly comprising:

a conical head that comprises:

a conical diverter and a jacket; and said jacket comprising a plurality of jacket through holes for dispersing the flow of heated gas evenly through said nozzle assembly and for increasing the pressure and velocity of the flow of heated gas;

a spindle abutting said conical head, said spindle comprising:

a stalk and a sheath;

said stalk for providing structure for said nozzle assembly and maintaining the position of said nozzle assembly in said apparatus housing; and said sheath comprising plurality of sheath through holes that align with said jacket through holes, said sheath through holes for increasing the pressure and velocity of the flow of heated gas through said nozzle assembly;

a retainer abutting said spindle;

a diverter abutting said movable sleeve for increasing the pressure and velocity of the flow of heated gas after the flow of heated gas passes through said retainer, said diverter imposing a 90-degree bend in the direction of the flow of the heated gas as a flat surface, without the use of gentle curves or radius, to cause the flow of heated gas to move said movable sleeve away from said apparatus housing to expose a circumferential diverter gap through which the flow of heated gas projects radially to perform the cutting function of the cutting system.

2. The apparatus housing of claim 1 in which said retainer comprises a heat resistant material to protect said sheath and the inner wall of said nozzle assembly from the heat generated by the flow of heated gas.

3. The apparatus housing of claim 1 in which said retainer comprises a heat resistant material to protect said sheath and the inner wall of said nozzle assembly from the heat generated by the flow of heated gas and said retainer includes a lip to protect said nozzle assembly at said circumferential diverter gap.

4. The apparatus housing of claim 1 in which said stalk and said sheath are two separate components.

5. The apparatus housing of claim 1 in which said conical diverter and said jacket are two separate components.

6. The apparatus housing of claim 1 in which said jacket surrounds at least a portion of said spindle.

7. The apparatus housing of claim 1 in which said jacket and said sheath are a single component.

8. The apparatus housing of claim 1 in which said spindle is installed within said apparatus housing with screw threads.

9. The apparatus housing of claim 1 in which said apparatus housing further comprises an internal lip against which the various components of said nozzle assembly are pushed.

10. The apparatus housing of claim 1 in which said sheath through holes comprise heat resistant tubing.

11. The apparatus housing of claim 1 further comprising said retainer comprises a plurality of retainer through holes that align with said sheath through holes.

12. The apparatus housing of claim 1 in which said conical head has a length to diameter ratio greater than 1.0.

13. The apparatus housing of claim 1 in which said conical head has a length to diameter ratio between than 0.43 and 1.5.

14. The apparatus housing of claim 1 in which said conical diverter has an angle of less than 41 degrees.

15. The apparatus housing of claim 1 in which the said conical diverter has an angle of 31 degrees.

16. The apparatus housing of claim 1 in which said retainer has a length to width ratio between 0.5 and 0.25.

17. The apparatus housing of claim 1 further comprising a constricted section that supports combustible pellets above said nozzle assembly.

18. The apparatus housing of claim 1 further comprising a constricted section that supports combustible pellets above said nozzle assembly and said constricted section is a retaining nut.

19. The apparatus housing of claim 1 further comprising a constricted section that supports combustible pellets above said nozzle assembly and said constricted section burns away after ignition of the combustible pellets to reduce the level of constriction.

20. The apparatus housing of claim 1 further comprising:

a constricted section that supports combustible pellets above said nozzle assembly;

said constricted section has a diameter that obstructs the flow of heated gas to the nozzle assembly; and said constricted section has an inner diameter burns away after ignition of the combustible pellets to reduce the level of constriction and present an unobstructed flow path to said conical head.

21. The apparatus housing of claim 1 further comprising a constricted section that supports combustible pellets above said nozzle assembly and said constricted section builds the pressure in said apparatus housing to aid conduit cutting when pressures in conduit are in the range of zero to 1,000 psi.

22. The apparatus housing of claim 1 in which said retainer is mounted within said apparatus housing with screw threads.

23. The apparatus housing of claim 1 in which epoxy or high temperature sealant is used to seal any loose space within the apparatus housing.

* * * * *